United States Patent [19]

Boy

[11] Patent Number: 4,718,318

[45] Date of Patent: Jan. 12, 1988

[54] FLOW PATH SELECTOR VALVE FOR USE IN WIND INSTRUMENTS MADE OF METAL

[76] Inventor: Joseph P. Boy, Panoramastrasse 9, D-7530 Pforzheim-Büchenbronn, Fed. Rep. of Germany

[21] Appl. No.: 907,899

[22] Filed: Sep. 16, 1986

[30] Foreign Application Priority Data

Sep. 19, 1985 [DE] Fed. Rep. of Germany ..... 3533400

[51] Int. Cl.[4] ..... G10D 9/04

[52] U.S. Cl. ..... 84/390; 84/388; 84/393

[58] Field of Search ..... 84/388–391, 84/393

[56] References Cited

U.S. PATENT DOCUMENTS 3,881,388 5/1975 McCracken ..... 84/390 X 4,095,504 6/1978 Hirsbrunner ..... 84/390

*Primary Examiner*—Benjamin R. Fuller

*Attorney, Agent, or Firm*—Balogh, Osann, Kramer, Dvorak, Genova & Traub

[57] ABSTRACT

This invention relates to a flow path selector valve for use in wind instruments made of metal, such as a trumpet or a French horn. The valve comprises at least one pair of valve members, which consist each of a solid of revolution and are rotatably mounted on opposite sides of and in sliding and sealing contact with a centrally disposed, hollow bearing and drive block and integrally connected by a shaft. Each of said valve members consists of a cylinder, preferably of a cone, and contains a curved pipe section, which defines a flow path from an axial opening formed in the axially outer end portion of the valve member to a lateral opening formed in the shell of the valve member. The curved pipe sections are arranged in mirror symmetry in the valve members of said pair. Two air ducts are provided on opposite sides of the pair of valve members and devine flow paths differing in length. Each of said air ducts has two openings at opposite ends. The valve members are adapted to rotate in unison, preferably through 180°, between a first position in which the lateral openings of both valve members register with the two openings of one of said air ducts and a second position, in which the lateral openings of both valve members register with the openings of the other air duct. The two open ends of each of said air ducts are defined in part by the centrally disposed bearing and drive block.

31 Claims, 12 Drawing Figures

FLOW PATH SELECTOR VALVE FOR USE IN WIND INSTRUMENTS MADE OF METAL

BACKGROUND OF THE INVENTION

1. Field of the Invention

This invention relates to a flow path selector for use in wind instruments made of metal, such as trumpets or horns, which valve comprises a pair of valve members, which are integrally connected.

2. Description of the Prior Art

For use as flow path selector valves of wind instruments made of metal, so-called Perinet valves are known as well as rotary valves.

A Perinet valve comprises a cylinder, in which a piston is longitudinally slidable against spring force. The piston has longitudinal and transverse bores so that the air can be conducted along a shorter or longer path for a generation of different tones. The passages are round in cross-section so that they permit of a free flow of the air; this is desirable for achieving a large sound volume and a high quality of the tone. But the long actuating stroke and the high inertia of said valves oppose a fast playing.

A rotary valve comprises a valve disc, which is provided at its periphery with air inlets and air outlets, and said inlets and outlets communicate with each other through radial or sector-like passages. Whereas such valve permits of a fast playing owing to its short actuating stroke, the air flowing in the air passages is strongly deflected by sharp edges and constrictions formed in the disc so that the sound volume and the quality of the tone as well as the ease with which the tone can be produced will be adversely affected.

German Patent Specification No. 29 18 247 discloses a rotary valve which comprises a pair of valve members, which are non-rotatably connected and consist each of a solid of revolution, which is provided with a curved pipe section and formed with an axial opening in an outer end portion and with a lateral opening in the shell of the valve member. Said lateral opening can be connected by one or the other of two air ducts, which define flow paths differing in length. The selected flow path will depend on the position to which the valve members have been rotated. That valve is specially designed for a particular instrument, e.g., for a triple horn having a plurality of tuning slides which are to be controlled.

SUMMARY OF THE INVENTION

It is an object of the invention to provide a compact and light-weight flow path selector valve which is generally usable in wind instruments and has a continuous air passage, which is circular in cross-section, so that tones having a high quality and a large sound volume can easily be produced by means of the instrument and the latter can be played quickly because it is provided with a suitable mechanism.

In a flow path selector valve for use in wind instruments made of metal, such as trumpets or horn, which valve comprises a pair of valve members, which are integrally connected and consist each of a solid of revolution formed in an outer end portion with an axial opening and in a shell with a lateral opening, and two air ducts, which define flow paths differing in length, wherein said valve members are rotatable in unison to control the communication between said lateral openings and said air ducts, the object set forth is accomplished in accordance with the invention in that each solid of revolution consists of a cylinder or cone and at an inner end portion adjoins opposite ends of a centrally disposed, hollow bearing and driving block, each of said valve members is integrally connected to a shaft, which extends through said block, each of said valve members contains a curved pipe section, said curved pipe sections are preferably arranged in mirror symmetry and leave the axial openings substantially unrestricted, said lateral openings register with one of said air ducts in one angular position of the valve members and with the other of said air ducts in another angular position of the valve members, which angular positions are preferably offset 180° from each other, each of said air ducts has open ends, which are constituted in part by said block, the angle through which the flow path defined by each of said curved pipe sections is deflected is less than 90°, each of said air ducts has at each end a beveled or rounded inside surface, which is arranged to lead to the interior of one of said curved pipe sections when the latter registers with said end of said air duct, and the flow area of said curved pipe sections and said air duct in communication with said curved pipe sections is constant or defined by surfaces which flare in the direction of flow.

Each of said curved pipe sections is sealed to the associated valve member at the lateral opening thereof and each of said air ducts has at each of its ends an end face which is in sealing and sliding contact with said valve member. Each of said valve members has a relatively small wall thickness in a major portion of said shell and has a relatively large wall thickness in its inner and outer end portions and in a minor portion of said shell, which minor portion defines said lateral opening. Clearances are defined between portions of said shell and of said curved pipe section. Said major portion of said shell may consist of lightweight plastic. Said inner and outer end portions and said minor portion of said shell may consist of metal. Owing to that design the valve can be actuated by the player by a very small torque.

In a special embodiment the air duct defining the shorter flow path comprises a bent pipe which contacts said block and the air duct which defines the longer flow path comprises two tubular ports, which are rigid with said block and disposed on opposite sides thereof and a bent pipe connecting said tubular ports.

Alternatively, each of said air ducts may comprise two of such tubular ports and a bent pipe connecting said ports.

In the valve device having the design described hereinbefore, large round flow passages are provided, which are designed by gentle, slender curves, and the valve members are light in weight and associated with suitable drive means. As a rule, the valve comprises three series-connected pairs of valve members and two or three of such series arrangements of pairs of valve members may be provided one beside the other for use in dual or triple instruments.

The cylindrical or conical valve members consist of hollow bodies which accommodate the curved pipe sections so that the two valve members may be arranged in mirror symmetry and will be very light in weight. Besides, the valves may be arranged at an angle to each other.

DETAILED DESCRIPTION OF THE PREFERRED EMBODIMENTS

Further details of the invention are apparent from the following description of preferred embodiments of the invention shown on the drawings.

Figure 1:
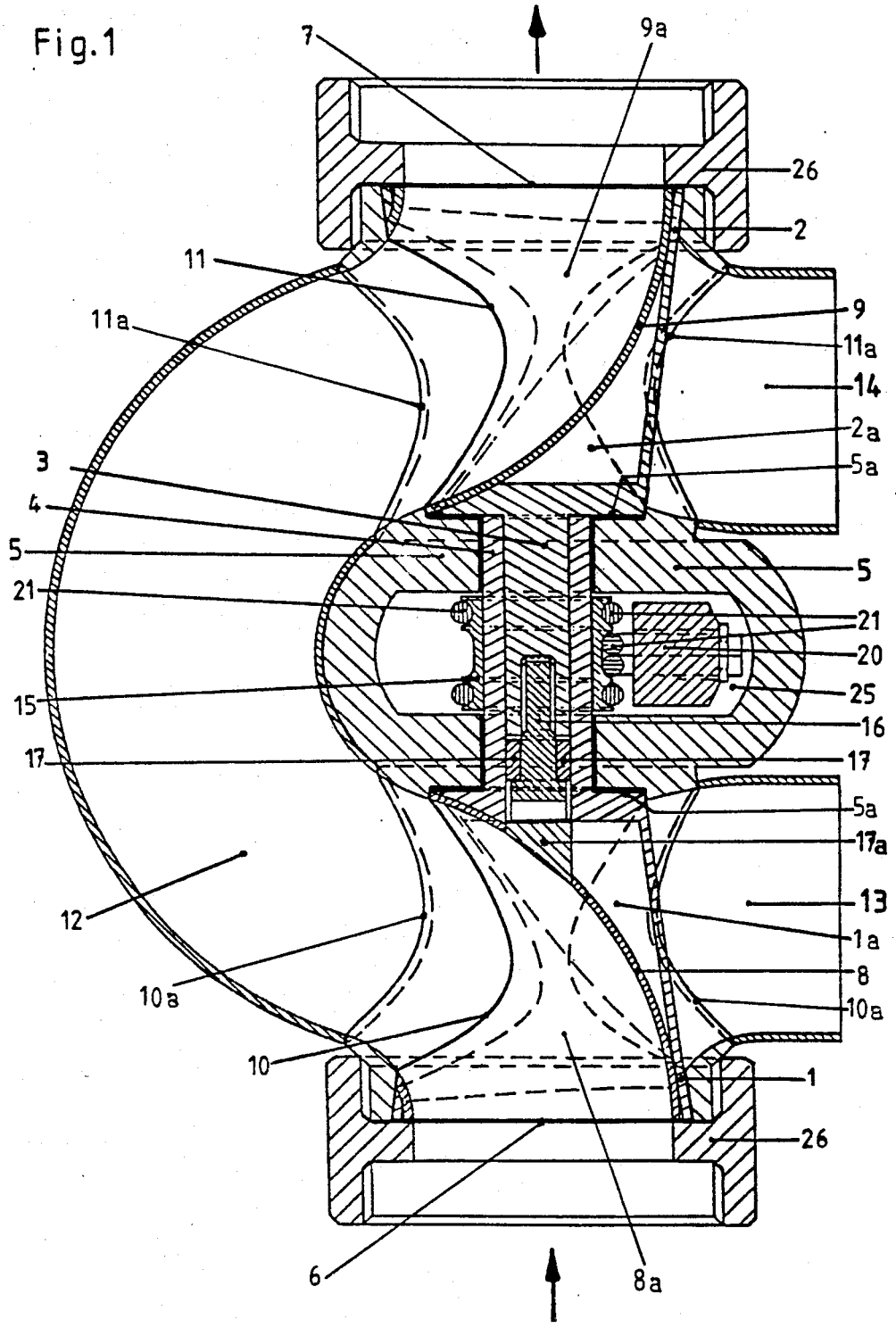
FIG. 1 is an enlarged longitudinal sectional view showing a pair of valve members in position of rest, and associated coupling sleeves.

In the embodiment shown in FIG. 1 in section, the valve comprises two outwardly widening, conical valve members 1 and 2, which are secured to a central shaft 3, 4, which is rotatably mounted in a centrally disposed bearing and drive block 5. Each of the conical valve members 1, 2, is formed in its outer end portion with a circular axial inlet opening 6 (in the valve member 1) or with a circular axial outlet opening 7 (in the valve member 2) and contains a curved pipe section 8 or 9 connecting said axial opening 6 or 7 to a lateral outlet opening 10 (in valve member 1) or to a lateral inlet opening 11 (in valve member 2). The lateral opening 10 or 11 is formed in the shell of the respective valve member 1 or 2. In a normal angular position of the valve members 1 and 2 the lateral openings 10 and 11 register with mutually opposite ends of an air duct, which comprises a bent pipe 12 and defines a relatively short flow path between the lateral openings 10 and 11. From said normal angular position, the valve members 1 and 2 can be rotated relative through 180° to a second angular position, in which the lateral openings 10 and 11 register with a second air duct, which defines a flow path that is longer than that defined by the air duct comprising the bent pipe 12. Each of the circular axial inlet and outlet openings 6 and 7 occupies almost the entire outer end face of the associated valve member 1 or 2 and is succeeded by the associated curved pipe section 8 or 9 leading to a lateral outlet or inlet opening 10 or 11, which is formed in the conical shell of the valve member and is a circular opening equal in diameter to the axial inlet or outlet opening. Each conical valve member 1 or 2 consists of a hollow body, which accomodates the associated curved pipe section so that the two valve members are very light in weight.

The angle between the directions of flow at opposite ends of each curved pipe section, i.e., the angle through which the air flowing through each curved pipe section is deflected, is less than 90°. Each of said curved pipe sections 8 and 9 is sealed to the shell of the valve member 1 or 2 at its lateral opening 10 or 11. Each of the air ducts has at each of its ends an end face which is in sealing and sliding contact with the adjacent valve member 1 or 2 and adjacent to said end face has an inside transition surface which is beveled or curved in longitudinal section and leads to the adjacent end of the curved pipe section 8 or 9.

It is apparent from the drawing that the flow area through the valve may be constant throughout the flow path from the axial inlet opening 6 to the lateral outlet opening 7 or may gradually increase in the direction from the axial inlet opening 6 to the lateral outlet opening 7.

Each of the valve members 1 and 2 which accommodates a curved pipe section 8 or 9 has an outer end portion formed with the axial inlet or outlet opening 6 or 7 and its shell comprises a rim defining the lateral outlet or inlet opening 10 or 11, which contains the peripheral end of the curved pipe section 8 or 9, and has a wall portion 1*a* or 2*a* in sealing contact with the periphery of the curved pipe section 8 or 9 at 8*a* or 9*a*. The valve members 1 and 2 are hollow and thin-walled and/or made of plastics so that they are light in weight. Portions of the shell of each valve member 1 or 2 and portions of the associated curved pipe section 8 or 9 define clearances between them.

The valve members 1 and 2 are nonrotatably connected by a shaft comprising a pin 3, which is rigid with the valve member 2, and a hollow shaft 4, which is rigid with the valve member 1. The pin 5 and the hollow shaft 4 protrude from the inner end face of the associated valve member 1 or 2. The pin 3 is fitted in the hollow shaft 4. A drive pulley 15 is fixedly mounted on the hollow shaft 4. The smaller, inner end faces of the conical valve members 1 and 2 are in sliding contact with a central bearing and drive block 5 with respective seals 5*a* interposed. The pin 3 is fixed in the hollow shaft 4 by means of an axial screw 16, which is screwed into a tapped bore at the free end of the pin 3 and axially bears on an internal retaining ring 17, which is fixed in the hollow shaft 4. An access to the screw 16 is permitted by a bore, which is formed in the wall of the curved pipe section 8 and in the inner end portion of the valve member 1 and communicates with the interior of the hollow shaft 4 and contains a removable plug 17*a*. In simple valves the screwed joint between the pin 3 and the hollow shaft 4 may be replaced by a glued joint.

Figure 7:
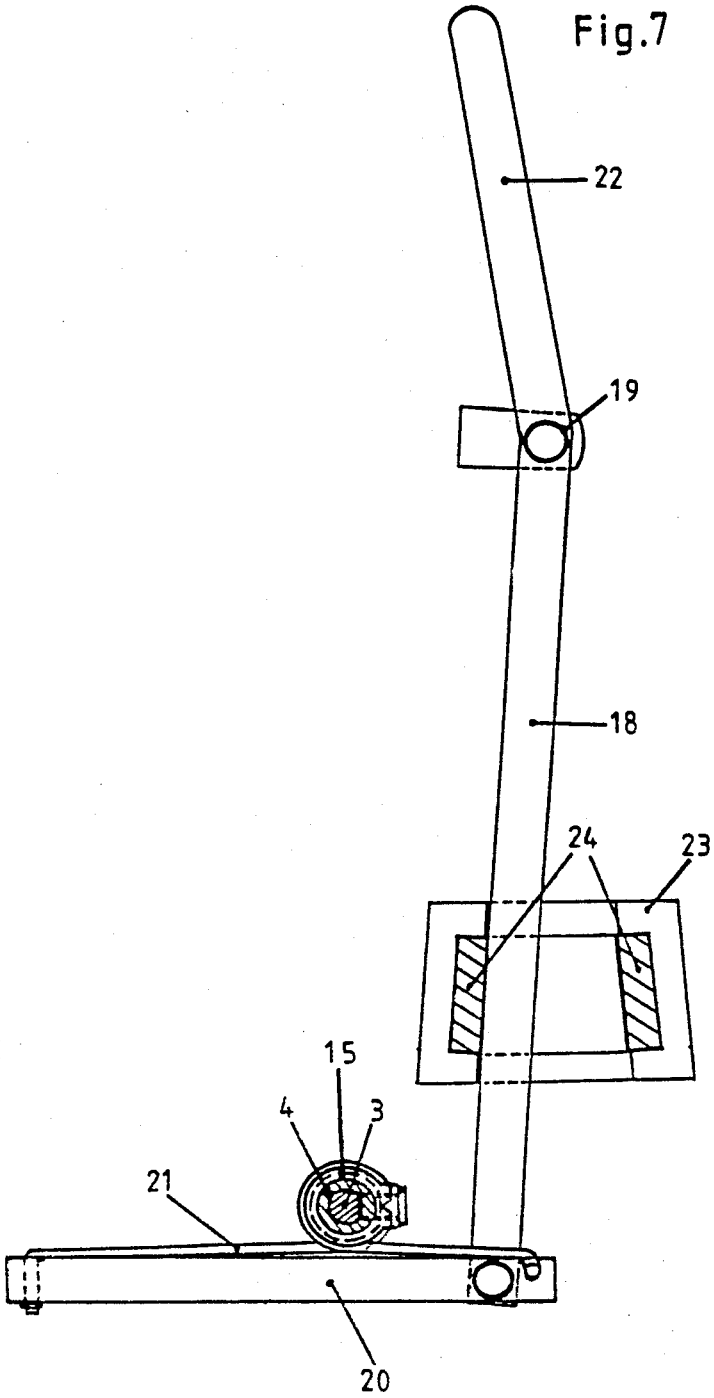
FIG. 7 is an enlarged side elevation showing the drive mechanism.

A mechanism for rotating the shaft 3, 4 is apparent from FIG. 7 and comprises a lever 18, which is biased to a position of rest about a pivot by a torsion spring 19. The lever 18 is pivoted at one end to a push rod 20. A drive cord or double cord 21 is secured to opposite ends of the push rod 20 and is trained around the drive pulley 15, which is fixed to the hollow shaft 4. The lever 18 is angled and comprises an actuating end portion 22. The lever 18 extends through and is guided by a slot-defining sleeve 23, which on opposite sides of the slot formed therein is provided with damping pads 24 for a soft limitation of the movement of the pivotal movement of the lever 18. The central bearing and drive block 5 accommodates the shaft 3, 4 and the drive pulley 15 and is formed with a lateral opening 25, through which the push rod 20 and the drive cord or double cord 21 extend.

Figure 2:
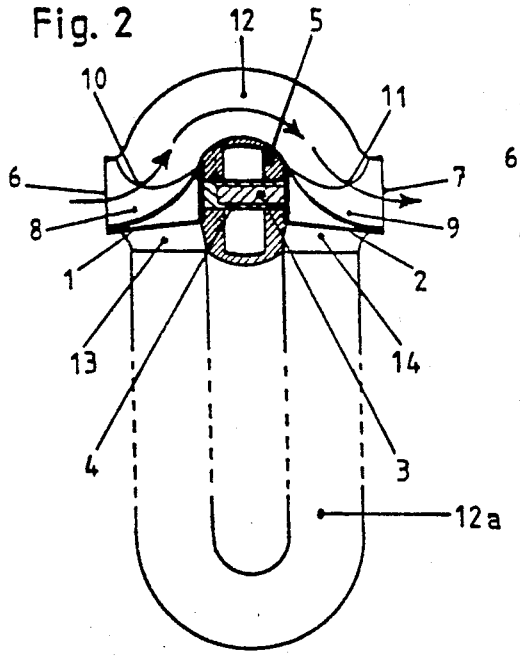
FIGS. 2 and 3 are diagrammatic longitudinal sectional views showing two valve members in position of rest and in actuated position, respectively.
Figure 3:
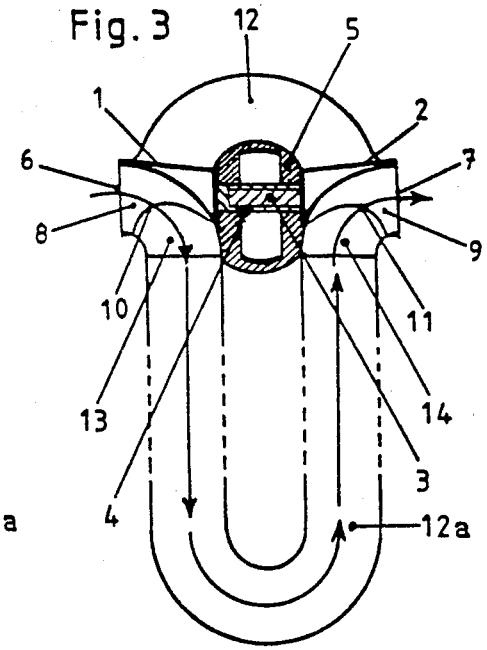

In valves comprising a series arrangement of pairs of valve members 1, 2, adjacent valve members of adjacent pairs are connected by tapped couplings 26, which have internal flanges and are used also to connect the valve members at the ends of the series to the piping of the wind instrument. In FIGS. 2 and 3, a pair of conical valve members 1, 2 are shown together with the shaft 3, 4, a bent pipe section 12 and tubular ports 13, 14 connected to a bent pipe section 12*a*. Said valve members are shown in position of rest and in a position resulting from a rotation of the valve members through 180°. The valve members 1, 2 are provided with an axial inlet opening 6, an axial outlet opening 7, a lateral outlet opening 10, a lateral inlet opening 11, and curved pipe sections 8 and 9 connecting the inlet opening 6, to the outlet opening 10 and the inlet opening 11 to the outlet opening 7. The bent pipe section 12 of the air duct defining the shorter flow path is at its periphery in contact with the central bearing and drive block 5. The bent pipe section 12*a* of the air duct defining the longer flow path is connected at opposite ends to tubular ports 13, 14, which are fixed to and disposed on opposite sides of the central bearing and drive unit 5.

It is apparent from FIG. 1 that adjacent to the bearing and drive block 5 the bent pipe 12 and each of the tubular ports 13 and 14 terminates short of the valve member 1 or 2 so that each of the air ducts comprising the bent pipe 12 or the tubular ports 13 and 14 is defined at each end by an inside transitional surface formed in part by the bearing and drive block 5. That surface is beveled or curved in longitudinal section and adapted to lead to the interior of the curved pipe section 8 or 9 when it registers with said open end of said air duct.

Figure 4:
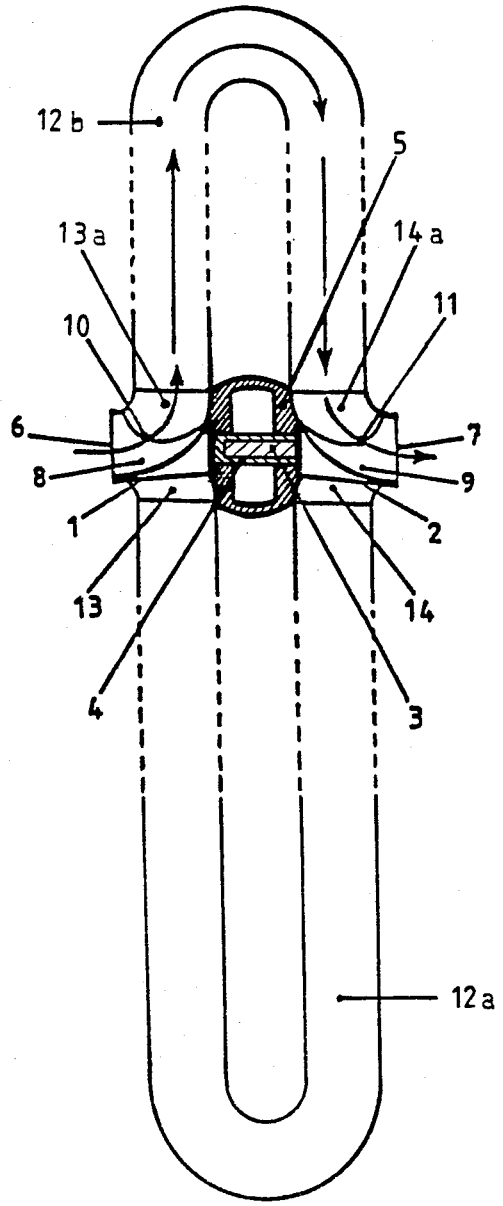
FIG. 4 is a diagrammatic longitudinal sectional view showing the two valve members in a position in which they define a different air flow path.

As is apparent from FIG. 4, flow paths differing in length may be defined by air ducts which comprise bent pipes 12*a*, 12*b*, each of which is adapted to be connected to the valve members 1, 2 by two tubular ports 13, 14 or 13*a*, 14*a*, which are respectively fixed to and disposed on opposite sides of the central bearing and drive block 5. In such an arrangement the two valve members may be arranged in mirror symmetry and may be angularly offset from each other with respect to the shaft 3, 4.

Figure 5:
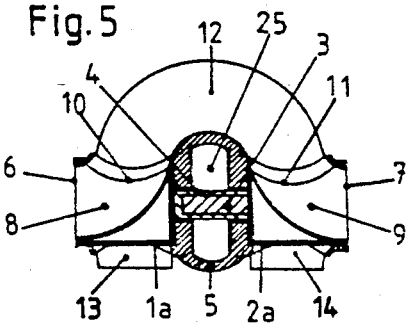
FIG. 5 is a diagrammatic longitudinal sectional view showing another embodiment of a valve comprising a pair of valve members.

A similar valve is shown in FIG. 5 and comprises cylindrical valve members 1*a* and 2*a*. The remaining parts of the valve correspond to those described hereinbefore. The central bearing and drive block 5 is also shown in FIG. 5. That valve is shown in FIG. 6 in a top plan view together with the actuating lever 18 and the push rod 20, and the double drive cord 21 of the drive mechanism and internally flanged, taped coupling sleeves 26.

Figure 6:
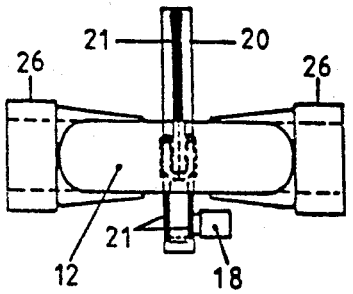
FIG. 6 is a top plan view showing two valve members and an associated drive.
Figure 8:
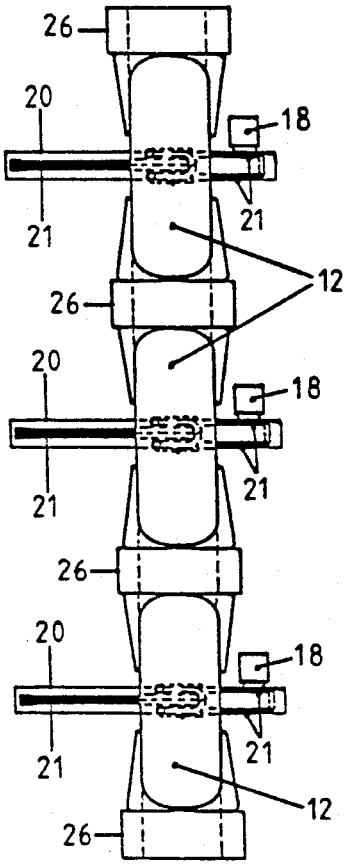
FIG. 8 is a top plan view showing a valve block for a wind instrument made of metal, which valve comprises three series-connected pairs of valve members and drive mechanisms.
Figure 9:
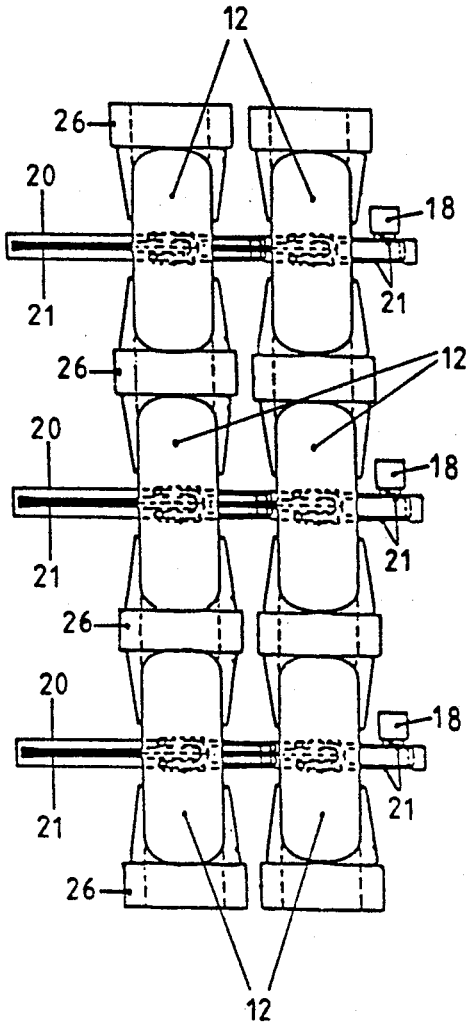
FIG. 9 is a top plan view showing a valve for a dual wind instrument made of metal, which valve comprises two rows each consisting of three series-connected pairs of valve members.

FIGS. 8 and 9, respectively show valve sets comprising a single row and a double row comprising three pairs of valve members in each row and a drive mechanism as shown in FIG. 6. A valve comprising three rows of three pairs of valve members each may also be provided.

Figure 10:
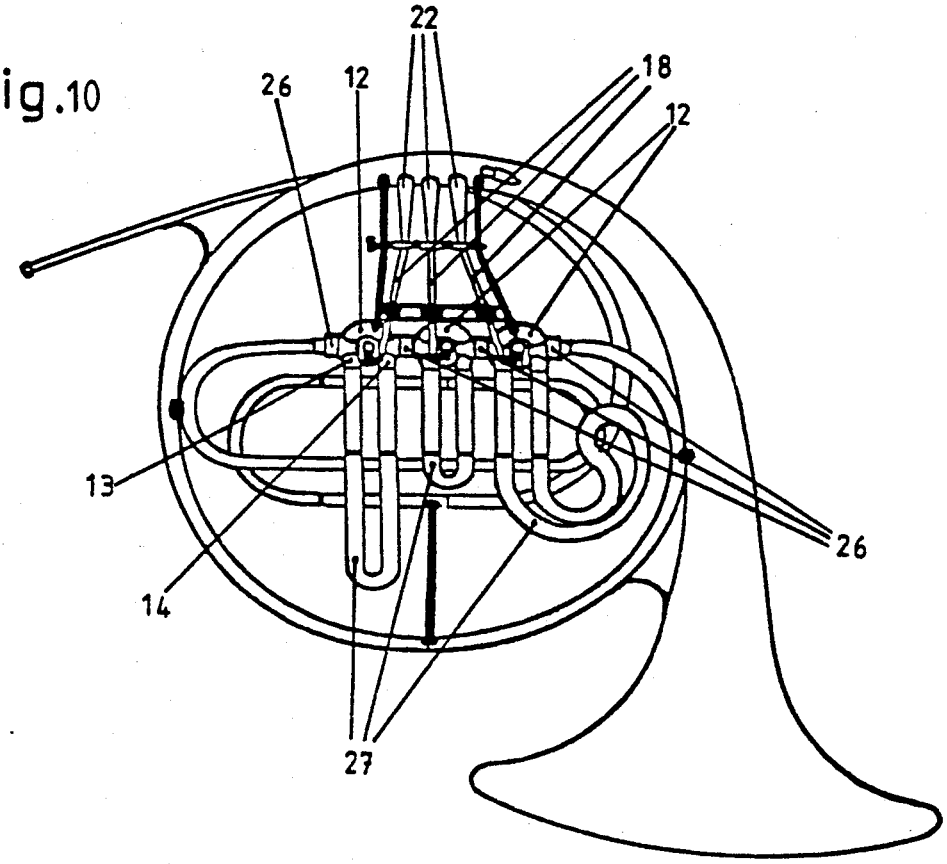
FIG. 10 is an elevation showing a French horn provided with three series-connected pairs of valve members.
Figure 11:
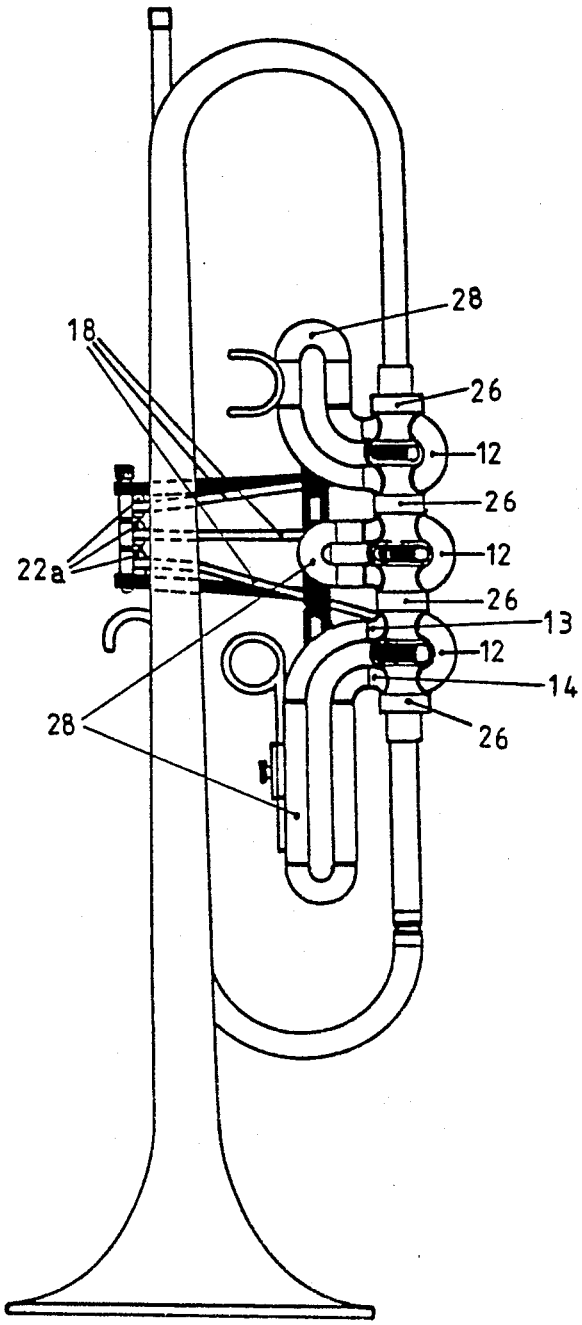
FIGS. 11 and 12 are, respectively, a side elevation and a top plan view showing a trumpet provided with three series-connected pairs of valve members.
Figure 12:
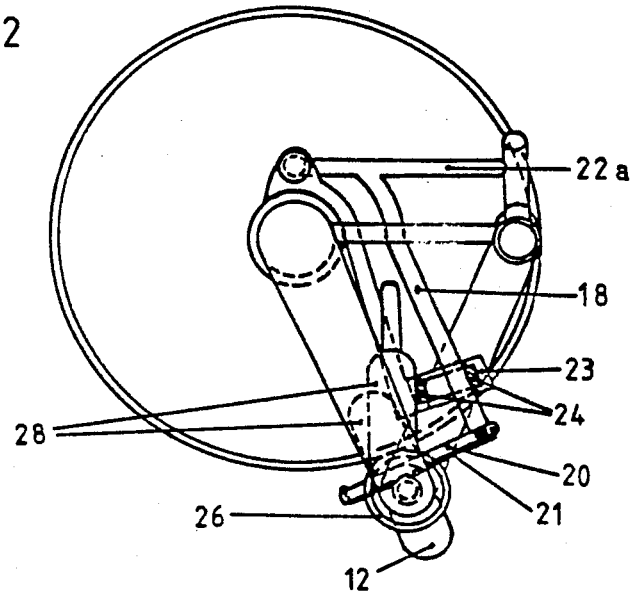

FIG. 10 shows by way of example a French horn. FIGS. 11 and 12 show a trumpet. Each of said wind instruments is provided with a row of pairs of valve members, which are coupled by means of flanged and tapped coupling sleeves 26, and provided with the lever 18, 22 or 22*a*. It is apparent that the bent pipes 27 and 28 connected to the tubular ports 13, 14 differ in length whereas the shorter bent pipes 12 have the same length. FIG. 12 is a top plan view of the trumpet shown in FIG. 11.

I claim:

1. In a flow path selector valve for use in a wind instrument made of metal, comprising at least one pair of coaxially arranged and rotatably mounted, first and second valve members consisting each of a solid of revolution and having an outer end portion formed with an axial opening, an inner end portion axially spaced from said outer end portion and a shell formed with a lateral opening, said inner end portions of said first and second valve members of said pair facing each other.

coupling means integrally connecting said inner end portions of said valve members, and first and second air ducts, which define respective flow paths differing in length, each of said ducts having mutually opposite first and second open ends, which face and are in sealing contact with respective ones of said valve members and adapted to register with said lateral openings of said valve members in different angular positions thereof, the improvement residing in that a hollow bearing and drive block is disposed between and in sliding contact with said inner end portions of said first and second valve members, said coupling means comprise a shaft extending through said block, said block contains drive means for rotating said shaft, and each of said valve members comprises a curved pipe section, which defines in said valve member a flow path leading from said axial opening to said lateral opening.

2. The valve set forth in claim 1 as applied to a valve for use in a wind instrument comprising a trumpet.

3. The valve set forth in claim 1, as applied to a valve for use in a wind instrument comprising a French horn.

4. The valve set forth in claim 1, wherein said curved pipe sections of said first and second valve members are arranged in mirror symmetry.

5. The valve set forth in claim 1, wherein said first ends of said first and second air ducts are spaced 180° apart about said shaft and said second ends of said first and second air ducts are spaced 180° apart about said shaft.

6. The valve set forth in claim 1, wherein said shells of said first and second valve members are conical.

7. The valve set forth in claim 1, wherein said block defines part of each of said first and second ends of said first and second air ducts and is in sealing contact with said curved pipe sections and said valve members at said lateral openings.

8. The valve set forth in claim 1, wherein each of said curved pipe sections defines a flow path extending from said axial opening to said lateral opening and curved through less than 90°.

9. The valve set forth in claim 1, wherein each of said air ducts has at each of said open ends a beveled inside transition surface.

10. The valve set forth in claim 1, wherein each of said air ducts has at each of said open ends an inside transition surface which is curved in longitudinal section.

11. The valve set forth in claim 1, wherein said flow paths defined by said air ducts and said flow paths defined by said curved pipe sections have a uniform flow area.

12. The valve set forth in claim 1 as applied to a valve in which said axial openings of said first and second valve members constitute axial inlet and outlet openings, respectively, wherein each of said flow paths defined by said curved pipe sections and said air ducts flares in the direction of flow from said axial inlet opening to said axial outlet opening.

13. The valve set forth in claim 1, wherein each of said air ducts has at each of its ends the same inside cross-sectional area and configuration as the associated curved pipe section at said lateral opening.

14. The valve set forth in claim 1, wherein each of said end portions has a larger wall thickness than at least a major portion of said shell.

15. The valve set forth in claim 14, wherein said shell comprises a minor portion which defines said lateral opening and has a larger wall thickness than said major portion.

16. The valve set forth in claim 1, wherein clearances are provided in each of said valve members between said shell and said curved pips section.

17. The valve set forth in claim 1, wherein said first air duct defines a relatively short flow path and comprises a first bent pipe in sealing contact with said block and said second air duct defines a relatively long flow path and comprises two tubular ports, which are rigid with said block, and a second bent pipe connecting said tubular ports.

18. The valve set forth in claim 1, wherein said shell and said curved pipe section of each of said valve members consist at least in a major part of plastic material.

19. The valve set forth in claim 18, wherein said outer end portion consists of metal and said shell comprises a metal portion defining said lateral opening.

20. The valve set forth in claim 1, wherein each of said air ducts comprises two tubular ports, which are rigid with said block, and a bent pipe connecting said tubular ports.

21. The valve set forth in claim 1, wherein a drive mechanism is provided for rotating said first and second valve members in unison and comprises a lever, which is pivotally movable between first and second positions, stop means defining said first and second positions, spring means urging said lever toward said first position, a push rod, which is pivoted to said lever and longitudinally reciprocable in response to an oscillating pivotal motion of said lever, a pulley non-rotatably connected to said shaft in said block and cord means which are secured to said push rod and trained around said pulley in frictional contact therewith and adapted to rotate said pulley in response to a pivotal movement of said lever between said first and second stops, the arrangement being such that said lateral openings of said first and second valve members register with said open ends of said first and second air ducts when said lever is in said first and second positions, respectively.

22. The valve set forth in claim 21, wherein said cord means comprise a double cord.

23. The valve set forth in claim 21, wherein at least two of said pairs of valve members are provided and arranged so that the associated ones of said shafts are parallel to each other, said push rod is associated with all said pairs of valve members and said cord means secured to said push rod are trained around all said pulleys which are non-rotatably connected to said shafts.

24. The valve set forth in claim 21, wherein said lever comprises first and second end portions, which extend at an angle to each other, said second end portion is pivoted to said push rod and said lever is pivoted between said first and second end portions.

25. The valve set forth in claim 21, wherein said stop means comprise two damping pads provided opposite to each other on the inside surface of a slot-defining sleeve which surrounds said lever and has side walls for guiding said lever between said pads.

26. The valve set forth in claim 1, wherein said shaft comprises a hollow shaft secured to one of said inner end portions and a pin secured to the other of said inner end portions and extending into and non-rotatably connected to said hollow shaft and said drive means are non-rotatably connected to said hollow shaft.

27. The valve set forth in claim 26, wherein said hollow shaft contains a ring disposed in and fixed to said hollow shaft and a fixing screw is rotatably mounted in said ring and screwed into said pin.

28. The valve set forth in claim 27, wherein said drive means comprises a pulley non-rotatably secured to said hollow shaft and a drive cord is provided, which is trained around said rope pulley.

29. The valve set forth in claim 1, wherein each of said outer end portions is annular and formed with external screw threads and a coupling sleeve having internal screw threads is screwed to each of said outer end portions and has radially inwardly directed flange, which is disposed axially outwardly of said outer end portion and clears the adjacent end of the flow path defined by the associated curved pipe section.

30. The valve set forth in claim 29, wherein at least two of said pairs of valve members are provided and are axially aligned and one of said coupling sleeves is screwed to said outer end portions of adjacent valve members of two adjacent ones of said pairs.

31. The valve set forth in claim 1, wherein each of said curved pipe sections leaves the axial opening of the associated valve member substantially unrestricted.

* * * * *